US005909801A

United States Patent [19]

Coffman

[11] Patent Number: 5,909,801

[45] Date of Patent: Jun. 8, 1999

[54] ARM WARMING SLEEVE

[76] Inventor: Howard B. Coffman, P.O. Box 753, Brave, Pa. 15316-0753

[21] Appl. No.: 09/036,418

[22] Filed: Mar. 5, 1998

[51] Int. Cl.[6] ..... A41D 13/08

[52] U.S. Cl. ..... 2/16; 2/59; 2/159

[58] Field of Search ..... 2/16, 59, 108, 2/159, 85, 93, 125, 126, 80, 91

[56] References Cited

U.S. PATENT DOCUMENTS

| | | | |
|---|---|---|---|
| D. 359,835 | 7/1995 | Hadfield | 2/59 X |
| 1,117,077 | 11/1914 | Mooney | 2/59 X |
| 1,796,782 | 3/1931 | Gasperini | 2/59 X |
| 2,045,157 | 6/1936 | Mathias | 2/59 X |
| 3,889,297 | 6/1975 | Jarboe et al. | 2/159 X |
| 4,229,833 | 10/1980 | Cox et al. | 2/16 |
| 4,356,570 | 11/1982 | Vernon et al. | 2/16 |
| 4,569,087 | 2/1986 | Kerwin | 2/16 X |
| 4,985,934 | 1/1991 | Perry | 2/125 |
| 5,357,633 | 10/1994 | Rael | 2/16 |
| 5,638,546 | 6/1997 | Vita | 2/16 |

*Primary Examiner*—Gloria M. Hale

[57] ABSTRACT

A arm warming sleeve for keeping an athlete's arm warm when they are out of the action. The inventive device includes a cylindrical sleeve having an open upper and a lower end. The cylindrical sleeve is dimensioned for receiving a throwing arm of a wearer. The cylindrical sleeve has an inner fleece layer, an intermediate plastic layer, and an outer fleece layer. The open lower end has hook and loop fasteners disposed around an outer periphery thereof. A glove portion is dimensioned for being worn on a hand of the wearer. The glove portion has an opening for receiving the hand therethrough. The opening has hook and loop fasteners disposed on an interior periphery thereof for engaging the hook and loop fasteners of the open lower end of the cylindrical sleeve. A shoulder flap is secured to the open upper end of the cylindrical sleeve. The shoulder flap is dimensioned for covering a front and rear of the wearers shoulder.

3 Claims, 2 Drawing Sheets

ARM WARMING SLEEVE

BACKGROUND OF THE INVENTION

1. Field of the Invention

The present invention relates to athletic sports equipment and more particularly pertains to an arm warming sleeve for keeping an athlete's arm warm when they are out of the action.

2. Description of the Prior Art

The use of athletic sports equipment is known in the prior art. More specifically, athletic sports equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art athletic sports equipment include U.S. Pat. No. 4,229,833 to Cox et al.; U.S. Pat. No. 4,569,087 to Kerwin; U.S. Pat. No. 5,357,633 to Rael; U.S. Pat. No. 4,985,934 to Perry; U.S. Pat. No. Des. 359,835 to Hadfield; and U.S. Pat. No. 4,356,570 to Vernon et al.

While these devices fulfill their respective, particular objectives and requirements, the aforementioned patents do not disclose a new arm warming sleeve. The inventive device includes a cylindrical sleeve having an open upper and a lower end. The cylindrical sleeve is dimensioned for receiving a throwing arm of a wearer. The cylindrical sleeve has an inner fleece layer, an intermediate plastic layer, and an outer fleece layer. The open lower end has hook and loop fasteners disposed around an outer periphery thereof. A glove portion is dimensioned for being worn on a hand of the wearer. The glove portion has an opening for receiving the hand therethrough. The opening has hook and loop fasteners disposed on an interior periphery thereof for engaging the hook and loop fasteners of the open lower end of the cylindrical sleeve. A shoulder flap is secured to the open upper end of the cylindrical sleeve. The shoulder flap is dimensioned for covering a front and rear of the wearers shoulder.

In these respects, the arm warming sleeve according to the present invention substantially departs from the conventional concepts and designs of the prior art, and in so doing provides an apparatus primarily developed for the purpose of keeping an athlete's arm warm when they are out of the action.

SUMMARY OF THE INVENTION

In view of the foregoing disadvantages inherent in the known types of athletic sports equipment now present in the prior art, the present invention provides a new arm warming sleeve construction wherein the same can be utilized for keeping an athlete's arm warm when they are out of the action.

The general purpose of the present invention, which will be described subsequently in greater detail, is to provide a new arm warming sleeve apparatus and method which has many of the advantages of the athletic sports equipment mentioned heretofore and many novel features that result in a new arm warming sleeve which is not anticipated, rendered obvious, suggested, or even implied by any of the prior art athletic sports equipment, either alone or in any combination thereof.

To attain this, the present invention generally comprises a cylindrical sleeve having open upper and lower end. The cylindrical sleeve is dimensioned for receiving a throwing arm of a wearer. The cylindrical sleeve has an inner fleece layer, an intermediate plastic layer, and an outer fleece layer. The open lower end has hook and loop fasteners disposed around an outer periphery thereof. A glove portion is dimensioned for being worn on a hand of the wearer. The glove portion has an opening for receiving the hand therethrough. The opening has hook and loop fasteners disposed on an interior periphery thereof for engaging the hook and loop fasteners of the open lower end of the cylindrical sleeve. A shoulder flap is secured to the open upper end of the cylindrical sleeve. The shoulder flap is dimensioned for covering a front and rear of the wearers shoulder. An elastic strap is provided having opposed ends secured to opposed edges of the open upper end of the cylindrical sleeve for looping under an underarm area of an opposed arm of the wearer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new arm warming sleeve apparatus and method which has many of the advantages of the athletic sports equipment mentioned heretofore and many novel features that result in a new arm warming sleeve which is not anticipated, rendered obvious, suggested, or even implied by any of the prior art athletic sports equipment, either alone or in any combination thereof.

It is another object of the present invention to provide a new arm warming sleeve which may be easily and efficiently manufactured and marketed.

It is a further object of the present invention to provide a new arm warming sleeve which is of a durable and reliable construction.

An even further object of the present invention is to provide a new arm warming sleeve which is susceptible of a low cost of manufacture with regard to both materials and labor, and which accordingly is then susceptible of low prices of sale to the consuming public, thereby making such arm warming sleeve economically available to the buying public.

Still yet another object of the present invention is to provide a new arm warming sleeve which provides in the apparatuses and methods of the prior art some of the advantages thereof, while simultaneously overcoming some of the disadvantages normally associated therewith.

Still another object of the present invention is to provide a new arm warming sleeve for keeping an athlete's arm warm when they are out of the action.

Yet another object of the present invention is to provide a new arm warming sleeve which includes a cylindrical sleeve having open upper and lower end. The cylindrical sleeve is dimensioned for receiving a throwing arm of a wearer. The cylindrical sleeve has an inner fleece layer, an intermediate plastic layer, and an outer fleece layer. The open lower end has hook and loop fasteners disposed around an outer periphery thereof. A glove portion is dimensioned for being worn on a hand of the wearer. The glove portion has an opening for receiving the hand therethrough. The opening has hook and loop fasteners disposed on an interior periphery thereof for engaging the hook and loop fasteners of the open lower end of the cylindrical sleeve. A shoulder flap is secured to the open upper end of the cylindrical sleeve. The shoulder flap is dimensioned for covering a front and rear of the wearers shoulder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
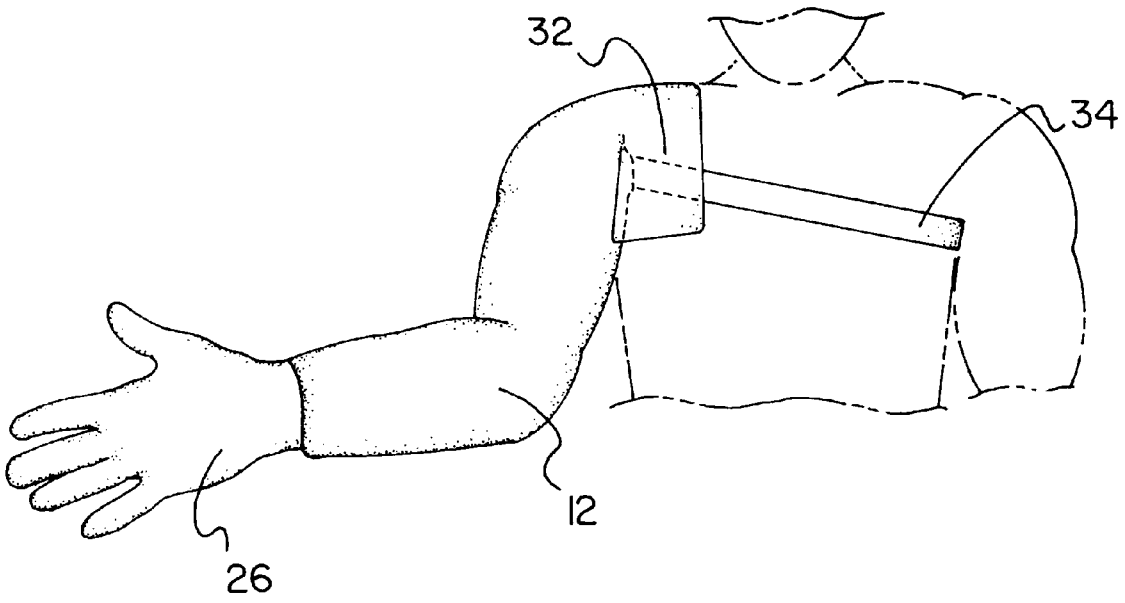
FIG. 1 is a front view of a new arm warming sleeve according to the present invention illustrated on a throwing arm of a wearer.
Figure 2:
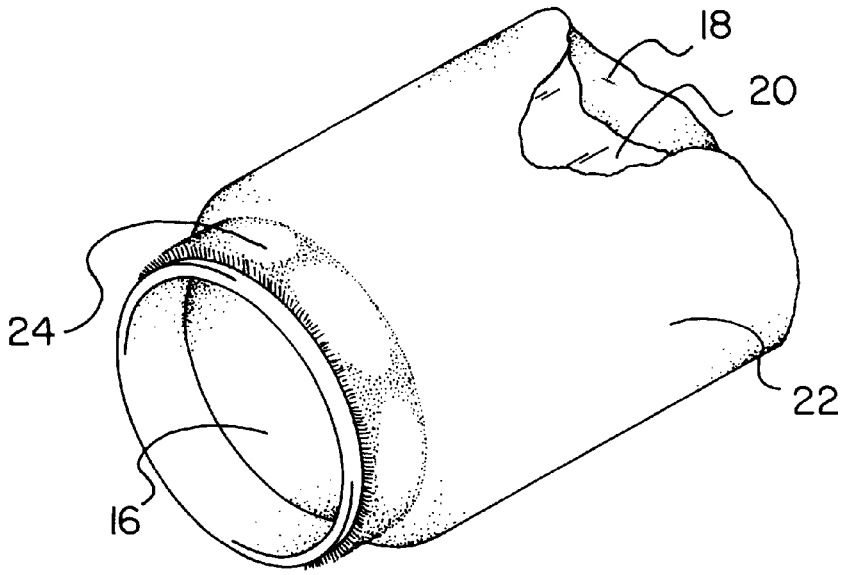
FIG. 2 is a perspective view of the present invention illustrating a lower end of the sleeve.
Figure 3:
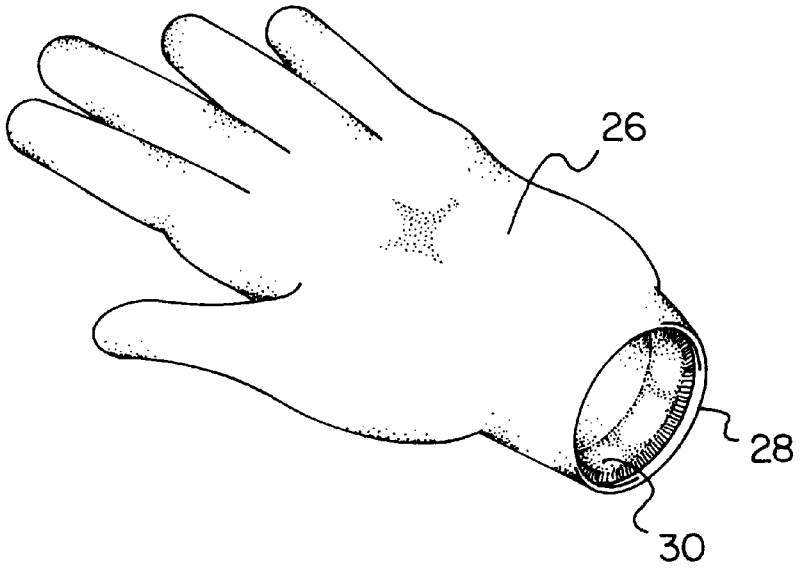
FIG. 3 is a perspective view of the glove portion of the present invention.
Figure 4:
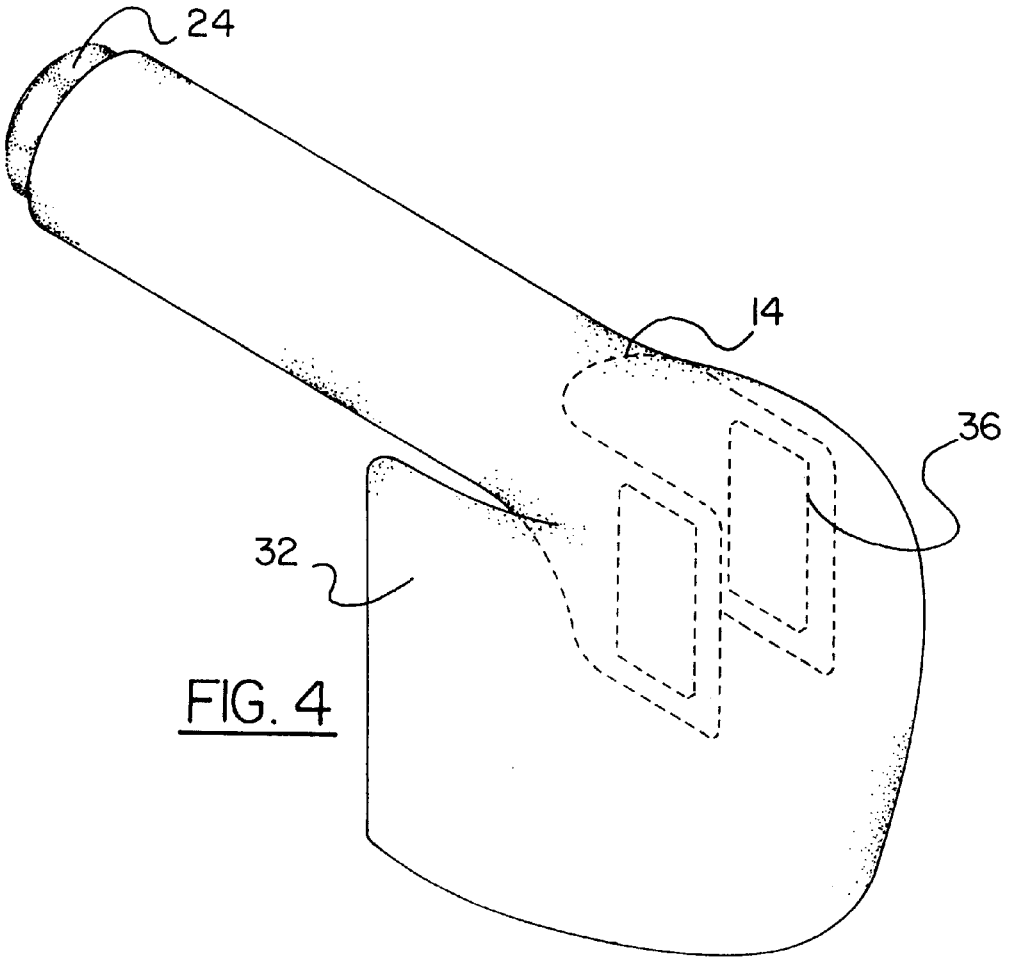
FIG. 4 is a perspective view of a second embodiment of the present invention.

With reference now to the drawings, and in particular to FIGS. 1 through 4 thereof, a new arm warming sleeve embodying the principles and concepts of the present invention and generally designated by the reference numeral 10 will be described.

As best illustrated in FIGS. 1 through 4, the arm warming sleeve 10 comprises a cylindrical sleeve 12 having open upper 14 and lower ends 16. The cylindrical sleeve 12 is dimensioned for receiving a throwing arm of a wearer. The cylindrical sleeve 12 has an inner fleece layer 18, an intermediate plastic layer 20, and an outer fleece layer 22. The open lower end 16 has hook and loop fasteners 24 disposed around an outer periphery thereof.

A glove portion 26 is dimensioned for being worn on a hand of the wearer. The glove portion 26 has an opening 28 for receiving the hand therethrough. The opening 28 has hook and loop fasteners disposed on an interior periphery thereof for engaging the hook and loop fasteners 24 of the open lower end 16 of the cylindrical sleeve 12.

A shoulder flap 32 is secured to the open upper end 14 of the cylindrical sleeve 12. The shoulder flap 32 is dimensioned for covering a front and rear of the wearers shoulder.

An elastic strap 34 is provided having opposed ends secured to opposed edges of the open upper end 16 of the cylindrical sleeve 12 for looping under an underarm area of an opposed arm of the wearer.

In an alternate embodiment, the elastic strap 34 is replaced by a pair of hook and loop strips 36 disposed interiorly of the open upper end of the cylindrical sleeve 12 to facilitate closure of the cylindrical sleeve 12 around the throwing arm of the wearer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An arm warming sleeve for keeping an athlete's arm warm when they are out of the action comprising, in combination:

a cylindrical sleeve having open upper and lower ends, the cylindrical sleeve being dimensioned for receiving a throwing arm of a wearer, the cylindrical sleeve having an inner fleece layer, an intermediate plastic layer, and an outer fleece layer, the open lower end having hook and loop fasteners disposed around an outer periphery thereof;

a glove portion dimensioned for being worn on a hand of the wearer, the glove portion having an opening for receiving the hand therethrough, the opening having hook and loop fasteners disposed on an interior periphery thereof for engaging the hook and loop fasteners of the open lower end of the cylindrical sleeve;

a shoulder flap secured to the open upper end of the cylindrical sleeve, the shoulder flap being dimensioned for covering a front and rear of the wearers shoulder; and an elastic strap having opposed ends secured to opposed edges of the open upper end of the cylindrical sleeve for looping under an underarm area of an opposed arm of the wearer.

2. An arm warming sleeve for keeping an athlete's arm warm when they are out of the action comprising, in combination:

a cylindrical sleeve having open upper and lower ends, the cylindrical sleeve being dimensioned for receiving a throwing arm of a wearer, the cylindrical sleeve having an inner fleece layer, an intermediate plastic layer, and an outer fleece layer, the open lower end having hook and loop fasteners disposed around an outer periphery thereof;

a glove portion dimensioned for being worn on a hand of the wearer, the glove portion having an opening for receiving the hand therethrough, the opening having hook and loop fasteners disposed on an interior periphery thereof for engaging the hook and loop fasteners of the open lower end of the cylindrical sleeve;

a shoulder flap secured to the open upper end of the cylindrical sleeve, the shoulder flap being dimensioned for covering a front and rear of the wearers shoulder.

3. The arm warming sleeve as set forth in claim 2 and further including a pair of hook and loop strips disposed interiorly of the open upper end of the cylindrical sleeve to facilitate closure of the cylindrical sleeve around the throwing arm of the wearer.

* * * * *